United States Patent [19]

Cherry et al.

[11] Patent Number: 4,478,479

[45] Date of Patent: Oct. 23, 1984

[54] ELECTRICAL TERMINAL

[75] Inventors: Hitesh Cherry, Harrisburg; Walter M. Werner, Downington, both of Pa.

[73] Assignee: AMP Incorporated, Harrisburg, Pa.

[21] Appl. No.: 407,671

[22] Filed: Aug. 13, 1982

[51] Int. Cl.[3] ..... H01R 4/50

[52] U.S. Cl. ..... 339/273 R; 72/410

[58] Field of Search ..... 339/270 R, 272 R, 273, 339/274; 72/410; 81/355, 362, 363

[56] References Cited

U.S. PATENT DOCUMENTS

| | | | |
|---|---|---|---|
| 1,566,153 | 12/1925 | McMunn | 339/273 R |
| 2,278,986 | 4/1942 | Gibbs | 339/273 R |
| 2,339,354 | 1/1944 | Rubel et al. | 339/273 R |
| 2,590,789 | 3/1952 | Noyes | 339/274 |
| 2,907,978 | 10/1959 | Bergan | 339/272 |
| 2,920,305 | 1/1960 | Gibson et al. | 339/272 |
| 2,935,551 | 5/1960 | Wells | 339/273 R |
| 3,292,363 | 12/1966 | Wahl | 227/9 |
| 3,349,167 | 10/1967 | Mixon, Jr. et al. | 174/94 |
| 3,564,956 | 2/1971 | Landen | 81/363 |
| 3,704,488 | 12/1972 | Higgins | 24/126 A |
| 4,136,549 | 1/1979 | Lytle et al. | 72/410 |
| 4,339,942 | 7/1982 | Svensson | 72/410 |

FOREIGN PATENT DOCUMENTS

| | | | |
|---|---|---|---|
| 924435 | 3/1955 | Fed. Rep. of Germany | 72/410 |
| 1029441 | 5/1958 | Fed. Rep. of Germany | 339/273 R |
| 464334 | 12/1968 | Switzerland | 339/273 |
| 1251546 | 10/1971 | United Kingdom | 72/410 |

*Primary Examiner*—John McQuade
*Assistant Examiner*—Gary F. Paumen
*Attorney, Agent, or Firm*—Allan B. Osborne

[57] ABSTRACT

The invention disclosed herein relates to terminals in which the electrical wire is removably retained by mechanical means. More particularly, the terminal includes a first member with an elongated body having an axial, wire-receiving first passage, a second, transverse passage intersecting the first passage and a second member having a wire engaging surface, the second member being driven into the second passage so that the wire engaging surface thereon may compress and retain a wire in the first passage.

1 Claim, 8 Drawing Figures

40
10
12
15
18
16
22
38
20
30
28
14
26
32
34

12
15
10
40
16
22
20
24
36
14
30
28
26

15
40
16
10
12
14
26

ELECTRICAL TERMINAL

BACKGROUND OF THE INVENTION

1. Field of the Invention

The present invention relates to wire-receiving terminals of the type wherein the wire is retained in one member by action of a second member.

2. Prior Art

The invention disclosed herein is a novel improvement and a departure from at least the following:

| U.S. Pat. No. | Patentee |
|---|---|
| 1,566,153 | McMunn |
| 2,907,978 | Bergan |
| 2,920,305 | Gibson et al. |
| 3,349,167 | Mixon |

McMunn discloses a device employing a wedge to draw two blocks together so that sharp edges on a projecting member of one or other of the blocks enter cable-receiving openings or passages to bite into and firmly grip the cables positioned therein. One block includes an opening to slidingly receive the other block. Both blocks have transverse, aligned slots or key ways to receive the wedge.

Bergan and Gibson et al discloses terminals having a longitudinal, wire-receiving passage with a side opening intersecting the passage. The opening, located on the top of the terminal for convenience, is threaded so that a bolt may be advanced into the passage to compress the wire against the passage wall for mechanical retention and electrical connection. Bergan includes a plate between the bolt tip and wire to reduce the rotating frictional resistence otherwise encountered by the bolt tip bearing directly against the wire. Further, the plate more uniformly distributes the compressive pressure across a wider area of the wire.

Other wedge type electrical devices include the wedge and C-member combination such as made and sold by AMP Incorporated of Harrisburg, Pa., under the trademark AMPACT. Such devices, disclosed in U.S. Pat. No. 3,349,167 receive a wire or cable in each of the arcuate sections of the C-member. The wedge is driven in between the wires to mechanically secure the assembly and electrically join the wires.

SUMMARY OF THE INVENTION

The invention disclosed herein is embodied in a terminal having a first member consisting of an elongated body with a first, axial passage therethrough and with a transversely extending, second passage intersecting the first passage and a second member with a wire engaging surface thereon to be driven into the second passage to wedge or compress a wire which may be positioned in the first passage to provide an electrical connection with the body and to retain the wire therein. Means are also provided to secure the second member in the second passage.

DESCRIPTION OF THE INVENTION

Figure 1:
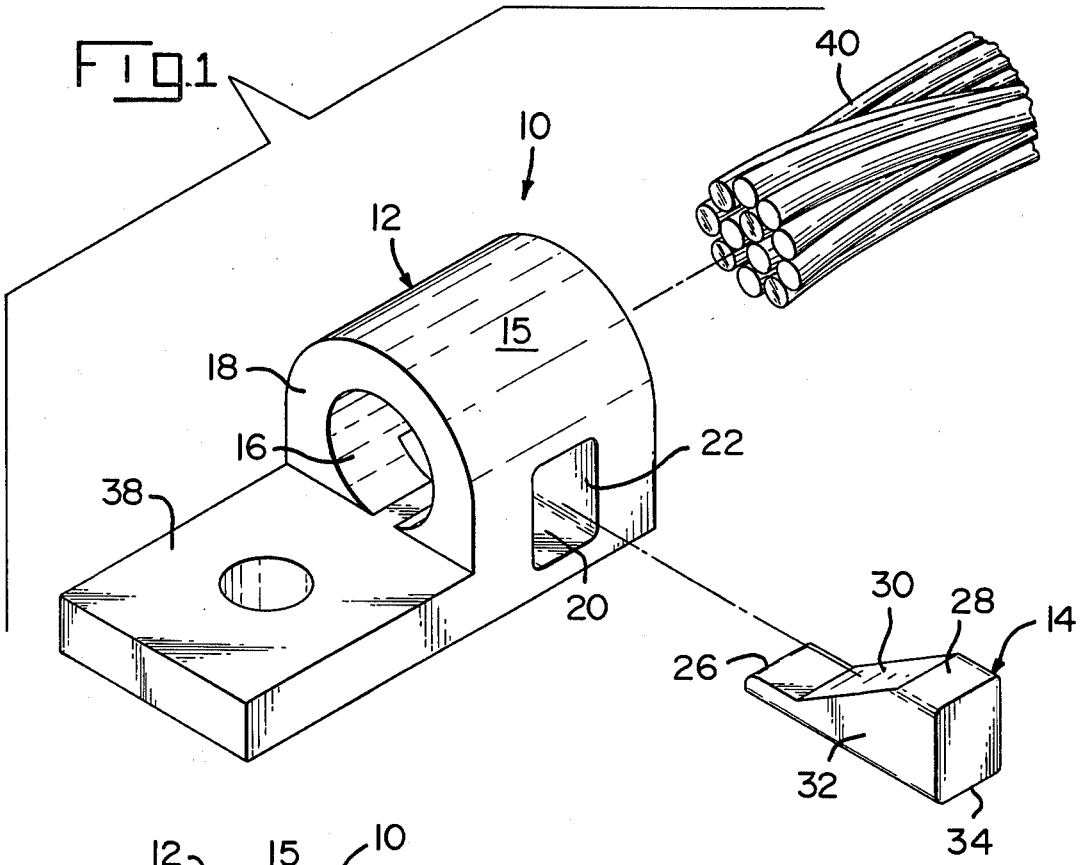
FIG. 1 is an isometric view showing the terminal constructed in accordance with the present invention and a multistrand wire to be terminated.

The terminal of the present invention, indicated generally by reference numeral 10 in all the figures, is perferrably made from a conductive material such as 6061-T-6 aluminum alloy. Other materials could be used as well.

With particular reference to FIG. 1, terminal 10 includes a first member 12 and second member 14. The first member includes body 15 having a first passage 16 extending axially therethrough. The passage could end inwardly from front face 18 of the body so that the front face would be solid thereacross. Such a modification would be desirable where one wished to fill the passage with a potting compound to have an environmentally sealed connection.

Second passage 20 extends transversely through body 15, intersecting first passage 16 thereby. The second passage has a large opening 22 on one side of the body, and a smaller opening 24 on the opposite side (FIG. 2).

Second member 14 has a thin, flat leading end 26 and a trailing end 28 of substantially greater thickness. A wire engaging surface 30 is provided on an intermediate section 32 which connects the two ends. The wire engaging surface shown is beveled or inclined. The changing thickness is reflected only in the top side of the intermediate section, leaving the under side 34 of the second member flat to slide conformably across floor 36 of second passage 20.

First member 12 may also include a connecting section such as tongue 38 shown in FIG. 1. Other similar connecting means may be utilized. Terminal 10 can also be used as a splice with only minor modifications to the embodiment illustrated.

Figure 2:
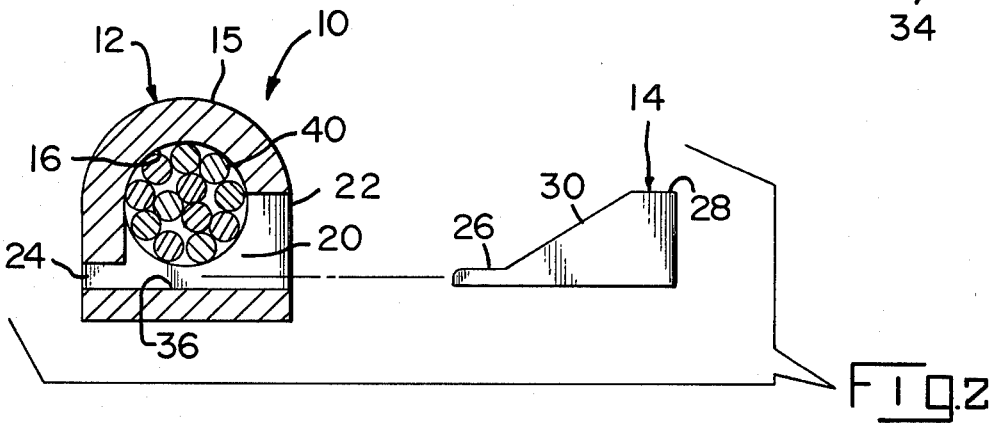
FIG. 2 is a transverse cross-sectional view of the terminal of FIG. 1 with the wire positioned within the terminal prior to being terminated.
Figure 3:
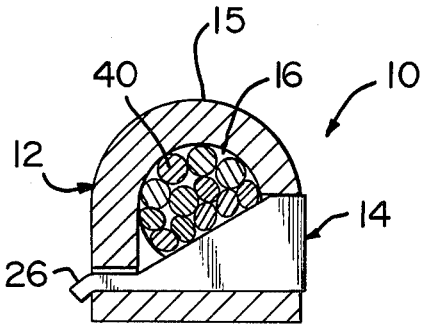
FIG. 3 is the same cross-sectional view as FIG. 2 but with the wire terminated.

FIGS. 2 and 3 illustrate wire 40 being terminated. A bared end of the wire is inserted into first passage 16 far enough to pass beyond the intersection of that passage with second passage 20. This is shown in FIG. 2. Second member 14 is pushed into the second passage, leading end 26 first, by hand as far as possible. Using a suitable tool, the second member is driven completely into body 15 so that end 26 extends out of opening 24. Wire engaging surface 30 engages the wire and the wire is substantially compressed into the decreasing space between surface 30 and the first passage wall. Leading end 26 is bent down to retain second member 14 in second passage 20. The wire is thusly secured in a crimped or compressed state to effect an extremely good electrical connection. FIG. 3 shows the final termination. Further, the wire is secured against axial pullout. Other means may be employed to retain the second member in the first member; e.g., an extremely tight, interference fit between leading end 26 and opening 24.

Second member 14 may be driven into second passage 20 by means of a hammer or other suitable tools. Two such tools are shown in FIGS. 4 and 5.

Figure 4:
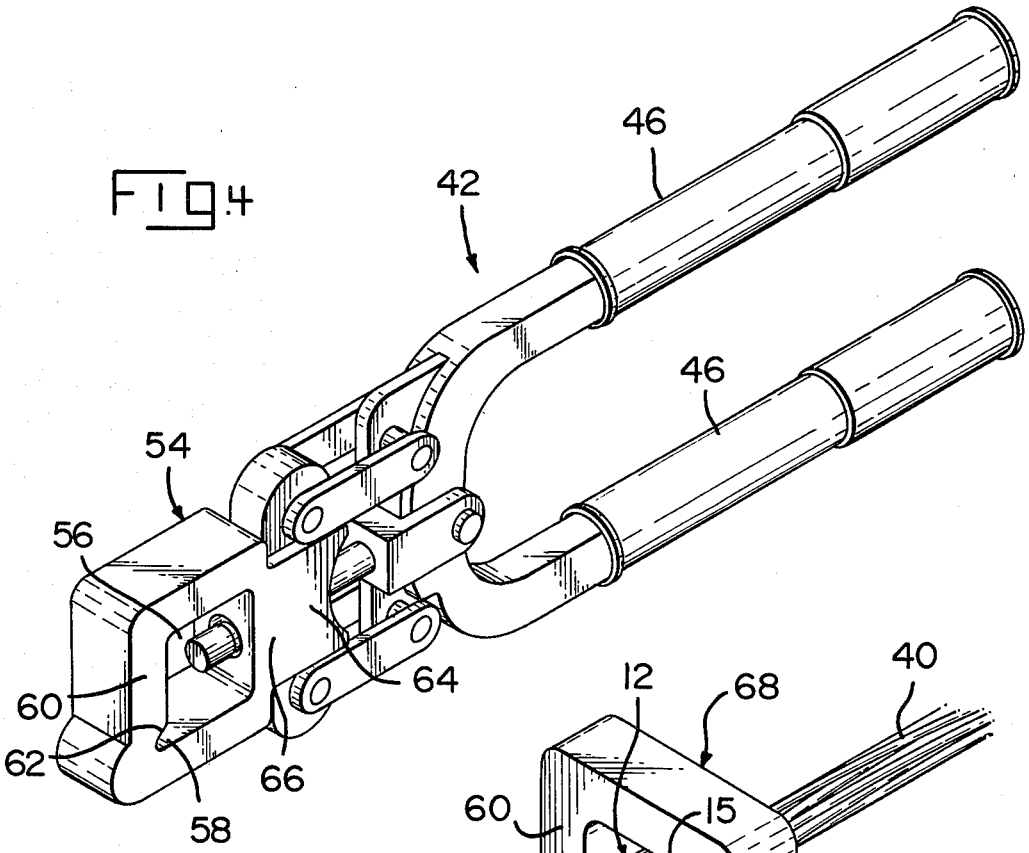
FIG. 4 is an isometric view of a hand-operated tool useful in termination wires in the terminals of the present invention.

Hand tool 42, shown in FIG. 4 utilizes a ram 44 which is reciprocated by handles 46 in a known manner.

Figure 5:
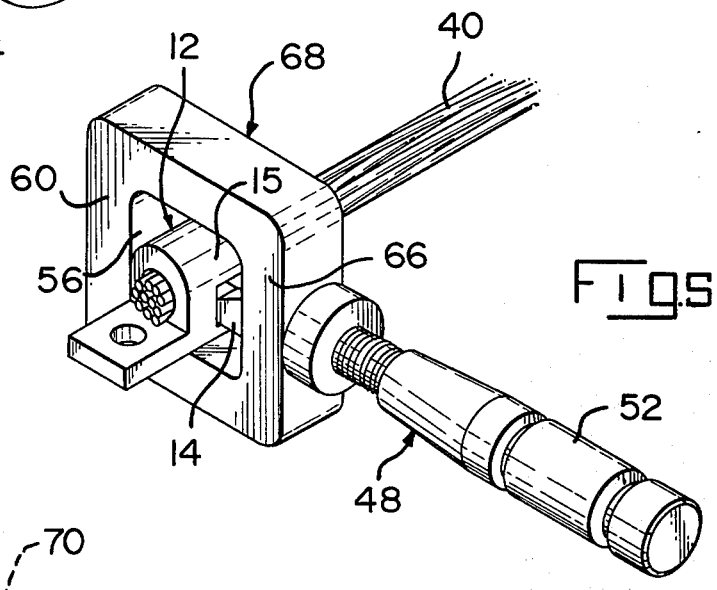
FIG. 5 is an isometric view of a power-actuated tool useful in terminating wires in the terminals of the present invention.

Powder actuated tool 48, shown in FIG. 5, drives a ram 50 (FIG. 6) by means of a propellant contained in handle 52. Such a tool is disclosed in U.S. Pat. No. 3,292,363.

Means for holding terminal 10 during the operation of driving second member 14 into body 15 by means of tool 42 includes a frame-shaped device 54. An opening 56 therethrough includes a notch 58 in one wall 60. A beveled surface 62 of the notch provides means for bending leading end 26 on second member 14 down as it emerges from opening 24.

Figure 6:
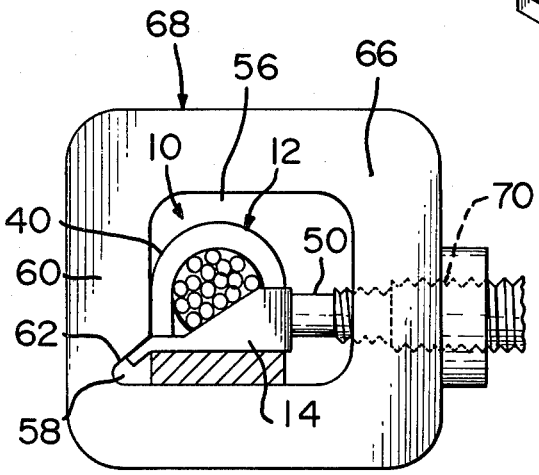
FIG. 6 is a view looking into the terminal, positioned in the tool of FIG. 5, after the wire has been terminated.

FIGS. 5 and 6 show the positioning of the terminal in opening 56 and against wall 60.

Device 54 includes a section 64 extending laterally from wall 66 which is opposite wall 60. This section adapts the device for use with hand tool 42. Ram 44 reciprocates through a passage in the section and wall 66.

Device 54 may be made separately and secured to the tool head by conventional means or may be made as an integral part.

Device 68 is a like frame-shaped device for use with tool 48. It differs from device 54 in respect to the manner in which it attaches to the tool. A threaded passage 70 in wall 66 (opposite wall 60) receives a threaded member on the tool (FIG. 6). Further, device 68 does not have a section 64 as on device 54.

In operation, body 15 is placed in opening 56 in the device with wire 40 in passage 16 (body 12) and second member 14 partially in second passage 20. Either ram 44 or 50, as the case might be, is caused to move forward, driving the second member into the body to secure the wire in the passage as noted above.

Figure 7:
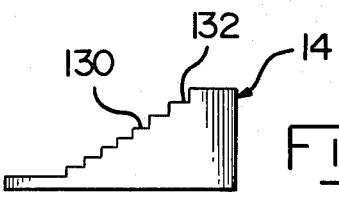
FIGS. 7 and 8 are views of alternate embodiments of one member of the terminal of the present invention.
Figure 8:
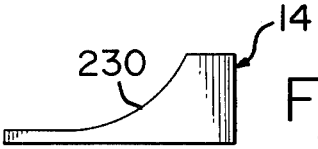

FIGS. 7 and 8 show second member 14 with different wire engaging surface configurations. The surface shown in FIG. 7, indicated by reference numeral 130, is stepped with the corners 132 provided thereby capable of biting into the wire strands.

A concave surface 230 is provided on the second member illustrated in FIG. 8.

Other surfaces may also be provided to fit different wire sizes and types.

The foregoing detailed description has been given for clearness of understanding only, and no unnecessary limitations should be understood therefrom, as some modifications will be obvious to those skilled in the art.

We claim:

1. In combination, an electrical terminal and device for terminating a wire therein, comprising:

a. a first member including an elongated body of conductive material and having a first passage extending axially therethrough and a second passage extending transversely therethrough and intersecting the first passage;

b. a second member adapted to be driven into the second passage and having thereon a wire engaging surface so that a wire which may be in the first passage may be compressed for electrical contact and for retention against axial pullout therefrom and further having a leading end which extends out from the body and which is susceptible to being bent such that it cannot be withdrawn from the second passage;

c. a frame-like structure having an opening therethrough to receive the first member, a notch with one beveled side located in the inside surface of one wall defining the opening, and a second opening in another wall opposing the one wall; and d. driving means positionable in the second opening for driving the second member into the second passage in the body and for driving the leading end of the second member into the notch whereby the leading end is bent out of line of the second passage so as to lock the second member therein.

* * * * *